US006166364A

United States Patent [19]

Ha

[11] Patent Number: 6,166,364

[45] Date of Patent: Dec. 26, 2000

[54] MICROWAVE OVEN HAVING A MICROWAVE DETECTING DEVICE

[75] Inventor: Jae-ki Ha, Seoul, Rep. of Korea

[73] Assignee: SamSung Electronics Co., Ltd., Suwon, Rep. of Korea

[21] Appl. No.: 09/421,380

[22] Filed: Oct. 20, 1999

[30] Foreign Application Priority Data

Jul. 28, 1999 [KR] Rep. of Korea ..... 99-30778
Jul. 28, 1999 [KR] Rep. of Korea ..... 99-30779

[51] Int. Cl.[7] ..... H05B 6/68

[52] U.S. Cl. ..... 219/709; 211/704; 211/720; 211/716

[58] Field of Search ..... 219/704, 705, 219/702, 709, 720, 716

[56] References Cited

U.S. PATENT DOCUMENTS

| | | | |
|---|---|---|---|
| 3,412,227 | 11/1968 | Anderson | 219/709 |
| 3,670,134 | 6/1972 | Bucksbaum | 219/709 |
| 4,009,359 | 2/1977 | Tallmadge et al. | 219/709 |
| 5,378,875 | 1/1995 | Hirama et al. | 219/705 |

FOREIGN PATENT DOCUMENTS

| | | | |
|---|---|---|---|
| 42 07 459 | 9/1993 | Germany | 219/704 |

*Primary Examiner*—Philip H. Leung
*Attorney, Agent, or Firm*—Robert E. Bushnell, Esq.

[57] ABSTRACT

A microwave detecting device outputs a first predetermined voltage in accordance with the presence/absence of microwave in a waveguide. A microcomputer inputs the first predetermined voltage, outputs a second predetermined voltage in accordance with the level of the first predetermined voltage, then detects the voltage of an input port of the first predetermined voltage by applying the second predetermined voltage to the input port of the first predetermined voltage, and displays the operational status of the microwave detecting section in accordance with the voltage detected from the input port. The microwave detecting section includes a diode sensor, which is connected between the waveguide and the input port of the microcomputer in a forward direction to output the first predetermined voltage in accordance with the presence/absence of the microwave in the waveguide. The microcomputer may further include a check button for applying a check signal to the microcomputer, and then the microcomputer outputs the second predetermined voltage in accordance with the inputted check signal.

28 Claims, 6 Drawing Sheets

MICROWAVE OVEN HAVING A MICROWAVE DETECTING DEVICE

CLAIM OF PRIORITY

This application makes reference to, incorporates the same herein, and claims all benefits accruing under 35 U.S.C. §119 from an application for MICROWAVE OVEN HAVING A MICROWAVE DETECTING DEVICE earlier filed in the Korean Industrial Property Office on the of Jul. 28, 1999 and there duly assigned Ser. Nos. 30778/1999 and 30779/1999.

BACKGROUND OF THE INVENTION

1. Field of The Invention

The present invention relates to a microwave oven, and more particularly, to a microwave oven having a microwave detecting device for detecting an operational status of a magnetron by detecting a microwave within a waveguide.

2. Description of The Prior Art

FIG. 1 is a partially cross-sectioned perspective view of a conventional microwave oven. As shown in FIG. 1, a door 4 is pivotedly fixed on one side of a body 1 to open/close a cooking chamber 2. A rotary plate 5 is arranged on the bottom of the cooking chamber 2, and food to be cooked is placed on the rotary plate 5. The reference numeral 7 refers to a control panel, i.e., a button inputting section, 8 is an air guide, and 9 is a cooling fan. A magnetron MGT is disposed in a device chamber 3. Accordingly, the air from the cooling fan 9 cools the device chamber 3, while being guided into the device chamber 3 through an air guide 8. The control panel 7 is formed on the front side of the device chamber 3. A user controls the operations of the microwave oven though various buttons of the control panel 7. Generally, the control panel 7 has a display 7A. The display 7A displays data from the button input section 7, the operational status of the microwave oven, and messages, etc.

FIG. 2 is a view for schematically showing a microwave detecting device of a conventional microwave oven. In FIG. 2, the reference character D refers to a diode sensor, and reference numeral 10 refers to a waveguide, 100 is a microwave detecting device, 120 is a shield member, and 130 is a microcomputer.

FIG. 3 is a circuit diagram of a microwave detecting section disposed in the waveguide of FIG. 2. As shown in FIG. 3, in the microwave detecting section 100, electric current produced by the electric field from a loop antenna 101 is detected through the diode sensor D, and a capacitor C is charged/discharged. Here, a certain voltage is outputted across a resistor R. A Zener diode ZD is used to prevent the voltage from being overly outputted.

The microwave detecting device of the conventional microwave oven has the shortcoming that it can not detect abnormal operation of the microwave oven, which is caused due to the non-oscillation of the magnetron MGT.

Further, the microwave detecting device of the conventional microwave oven can not detect the malfunction of the microwave oven, which is caused due to the breakage of the diode sensor D.

SUMMARY OF THE INVENTION

Accordingly, the present invention has been devised to overcome the above-described problems of the prior art, and accordingly, it is an object of the present invention to provide a microwave oven having a microwave detecting device capable of preventing abnormal operation of the microwave oven by detecting if the magnetron is functioning, and detecting if a diode sensor is broken.

The above-mentioned object will be accomplished by a microwave oven according to the present invention, including: a magnetron for generating a microwave into a waveguide; a controlling panel having a plurality of input buttons for setting data for cooking conditions, cooking menus, or the like; a microwave detecting section for outputting a first predetermined voltage in accordance with presence/absence of the microwave in the waveguide; a display section by which the operational status of the microwave oven is displayed; and a microcomputer for inputting the first predetermined voltage, outputting a second predetermined voltage in accordance with the level of the first predetermined voltage, detecting the voltage of an input port of the first predetermined voltage by applying the second predetermined voltage to the input port of the first predetermined voltage, and displaying the operational status of the microwave detecting section through the display in accordance with the voltage, which is detected from the input port of the first predetermined voltage.

The microwave detecting section includes a diode sensor, the diode sensor being connected between the waveguide and the input port of the microcomputer in forward direction to output the first predetermined voltage in accordance with the presence/absence of the microwave in the waveguide.

The display of the operational status of the microwave detecting section is accomplished by displaying the operational status of the diode sensor.

The second predetermined voltage is the voltage of a single pulse, and is applied to the input port through a resistor.

The second predetermined voltage is applied to the input port at a predetermined time interval, and the predetermined time interval is thirty seconds.

The microwave oven according to the present invention further includes a check button for applying a check signal to the microcomputer which outputs the second predetermined voltage in accordance with the inputted check signal.

The check button is formed on the control panel, and is the combination of a plurality of input buttons.

In the microwave oven according to the present invention, the microcomputer detects not only the microwave within the waveguide but also the presence of any abnormality in the diode sensor, and when an abnormality occurs in the microwave oven, it is displayed through the display section by indicating whether the abnormality of the microwave oven is due to the magnetron or due to the diode sensor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, the microwave oven having a microwave detecting device according to the embodiments of the present invention will be described in greater detail with reference to the accompanied drawings.

Figure 4:
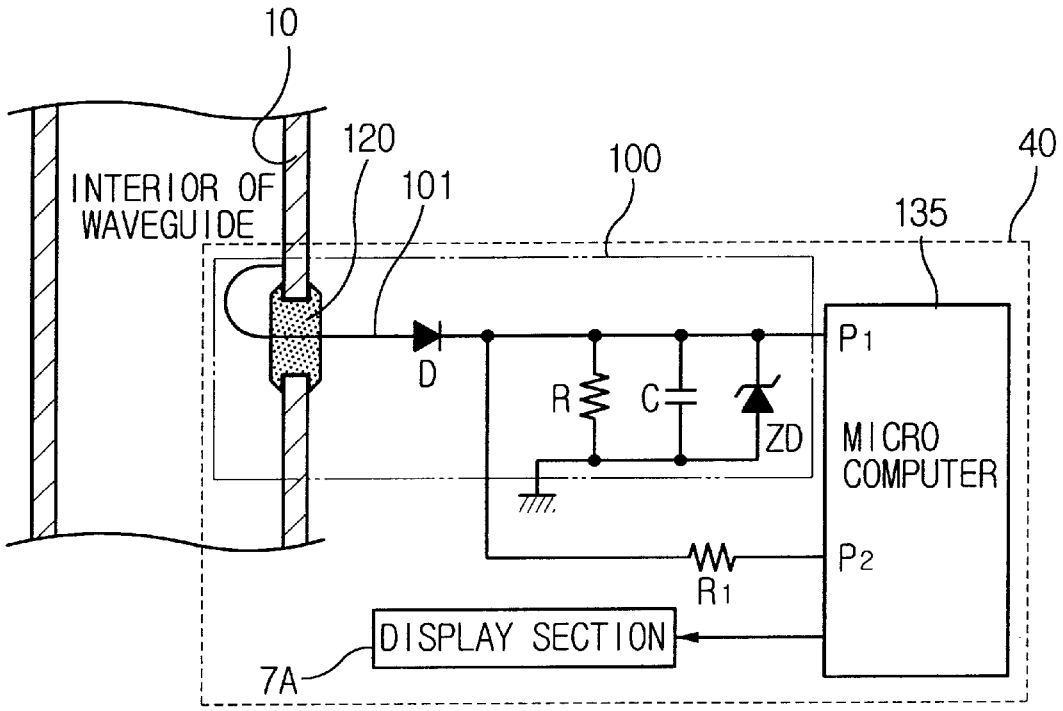
FIG. 4 is a circuit diagram for schematically showing a microwave oven having a microwave detecting device according to a first preferred embodiment of the present invention.

FIG. 4 is a circuit diagram for schematically showing a microwave oven having a microwave detecting device according to the first preferred embodiment of the present invention.

In FIG. 4, the reference numeral 40 refers to a microwave detecting device. The microwave detecting device 40 includes a microwave detecting section 100, a resistor R1, a display section 7A, and a microcomputer 135. The microwave detecting section 100 includes a diode sensor D which is connected between the waveguide 10 and a first port P1 of the microcomputer 135 in a forward direction. One end of the diode sensor D is grounded at the guide wave 10. The resistor R, capacitor C, and Zener diode ZD of the microwave detecting section 100 are connected with each other in parallel, and connected with the diode sensor D in series. The resistor R, capacitor C, and Zener diode ZD keep uniform output of the diode sensor D. The resistor R1 is connected between the first and second ports P1 and P2 of the microcomputer 135. The microcomputer 135 is also connected with the display section 7A. The display section 7A may be provided to the control panel 7, or may be separately formed on the front side of the microwave oven. The reference numerals 101 and 120 are, as described above, refer to a loop antenna and a shield member, respectively.

Figure 5:
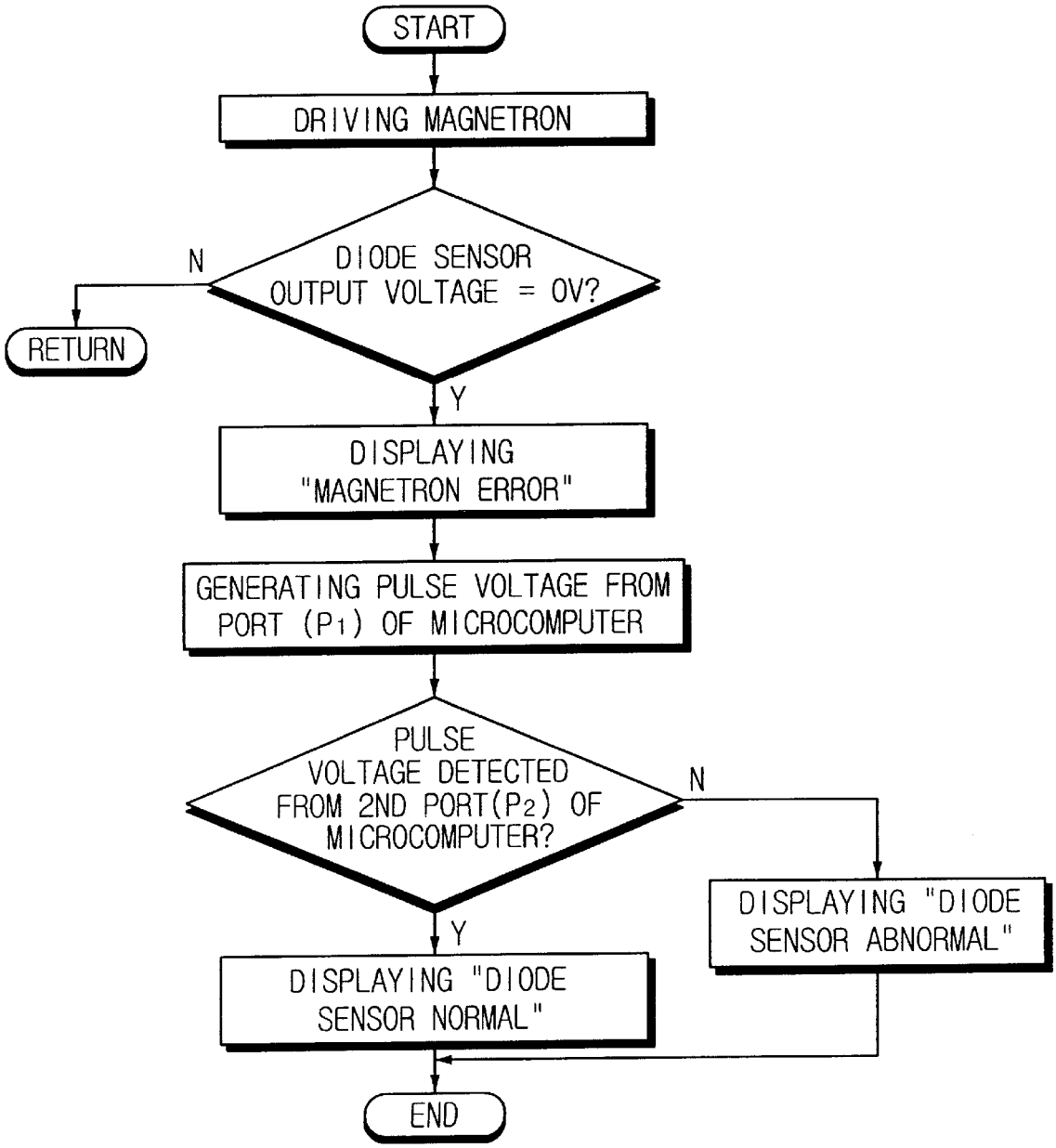
FIG. 5 is a flow chart for explaining operations of the microwave oven of FIG. 4.

The operations of the microwave oven having the microwave detecting device constructed as above will be described below:

FIG. 5 is a flow chart for explaining the operations of the microwave oven of FIG. 4.

As shown in FIG. 5, after placing the food to be cooked on the rotary plate 5, the user pushes a start button (not shown) of the control panel 7, and the magnetron MGT of the microwave oven starts its operation. In this situation, the microcomputer 135 detects the output voltage from the microwave detecting section 100. In other words, as the magnetron MGT operates, a microwave is generated and is transmitted to the cooking chamber 2 through the waveguide 10. Here, by the magnetic field formed within the waveguide 10, a voltage is induced at the diode sensor D. Such an induced voltage is charged/discharged by the resistor R and capacitor C, and outputted by the Zener diode ZD at a predetermined degree. However, if the magnetron MGT does not operate normally, the magnetic field is not formed in the waveguide 10, and accordingly, the voltage is not induced at the diode sensor D. Accordingly, voltage of 0V is outputted. After being outputted, the voltage of 0V is inputted to the first port P1 of the microcomputer 135. Here, when the voltage of 0V is inputted to the first port P1, i.e., when the voltage of 0V is outputted from the diode sensor D, the microcomputer 135 displays the magnetron error message through the display section 7A. Meanwhile, if the voltage of a predetermined degree is inputted to the first port P1, i.e., if the predetermined degree of voltage is inputted from the diode sensor D, the microcomputer 135 carries out the main algorithm.

As described above, when the voltage of 0V is inputted to the first port P1, the microcomputer 135 generates a pulse voltage from the second port P2 of the microcomputer 135. The pulse voltage of the second port P2 is detected at the first port P1 of the microcomputer 135 through the resistor R1. If the pulse voltage is detected by the first port P1 of the microcomputer 135, the microcomputer 135 displays a message indicating normal status of the sensor diode D, such as "diode sensor normal", or the like, through the display section 7A. If the pulse voltage is not detected at the first port P1 of the microcomputer 135, the microcomputer displays a message indicating an abnormality of the diode sensor, such as "diode sensor abnormal", or the like, through the display section 7A.

During the cooking operation of the microwave oven, the microcomputer 135 detects the magnetron MGT and the diode sensor D at predetermine time intervals, such as thirty (30) second intervals, or the like.

Figure 1:
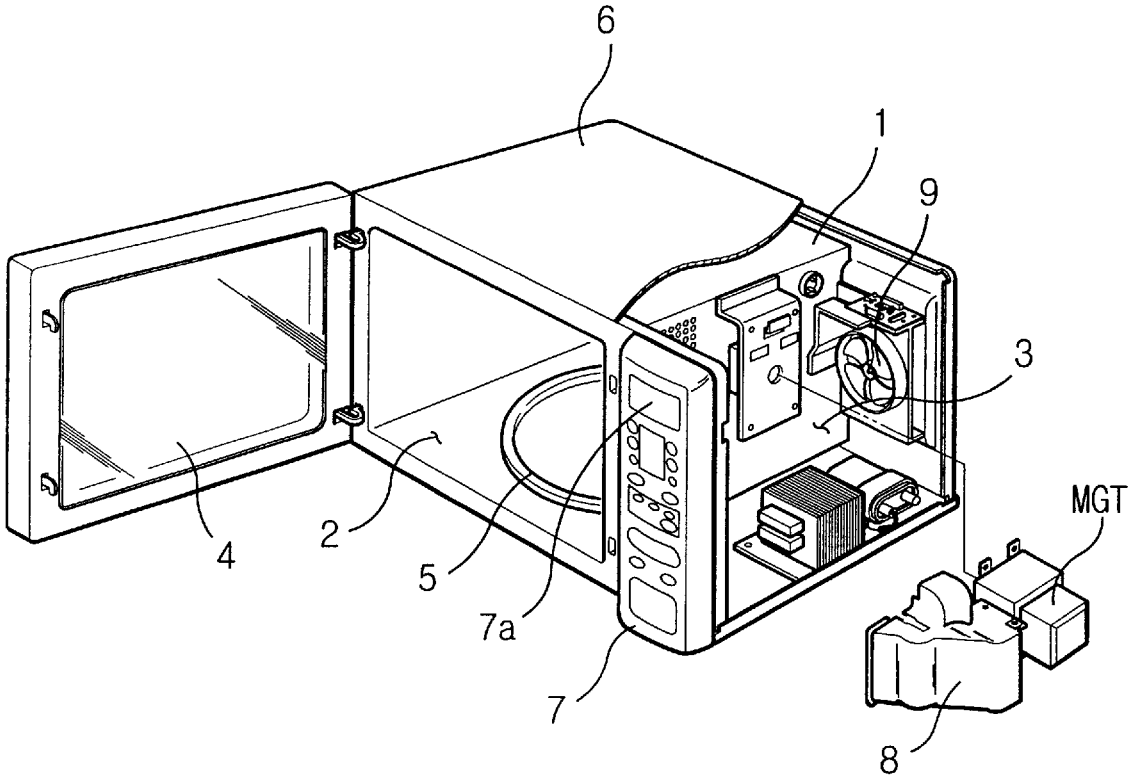
FIG. 1 (PRIOR ART)
FIG. 1 is a partially cross-sectioned perspective view of a conventional microwave oven.
Figure 2:
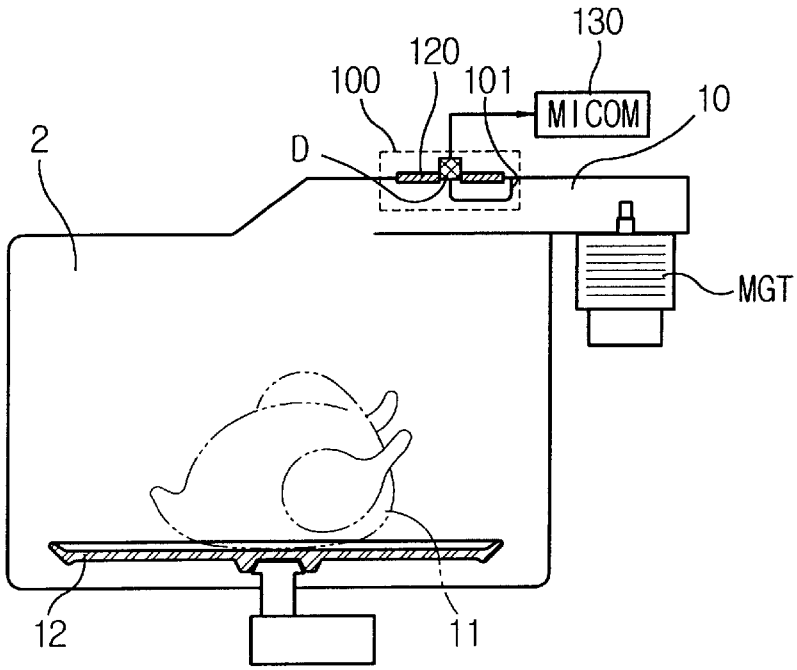
FIG.2 (PRIOR ART)
FIG. 2 is a view for schematically showing a microwave detecting device of the microwave oven of FIG. 2.
Figure 3:
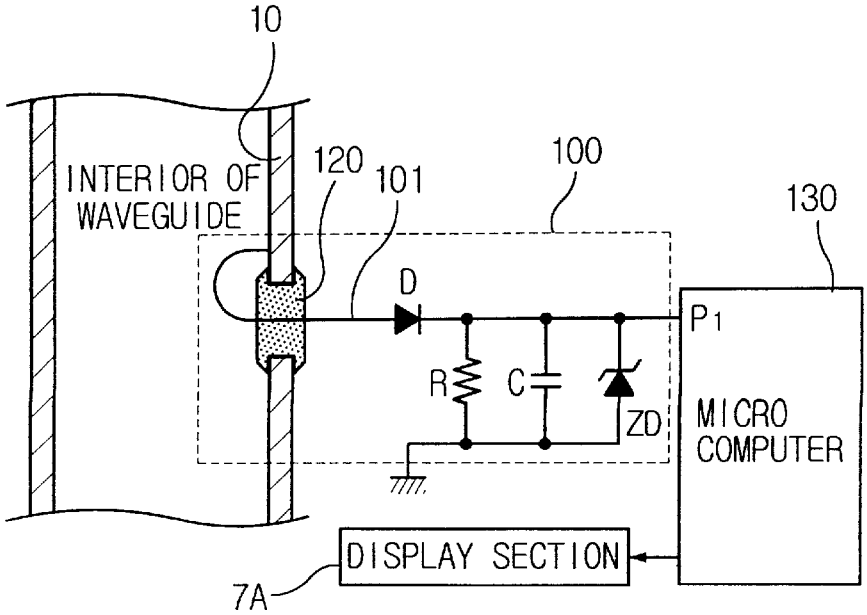
FIG.3 (PRIOR ART)
FIG. 3 is a circuit diagram for schematically showing the microwave oven having the conventional microwave detecting device.
Figure 6:
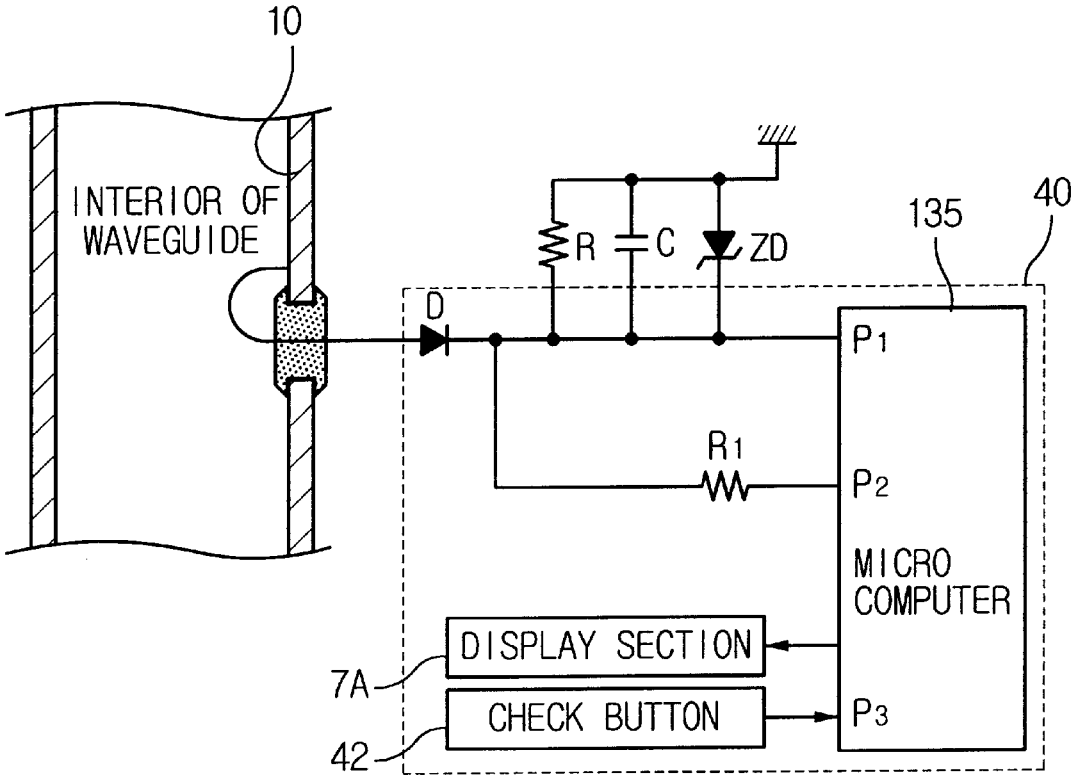
FIG. 6 is a circuit diagram for schematically showing a microwave oven having a microwave detecting device according to a second preferred embodiment of the present invention.

FIG. 6 is a circuit diagram for schematically showing a microwave oven having the microwave detecting device according to the second preferred embodiment of the present invention. As shown in FIG. 6, the reference numeral 42 refers to a check button. The check button 42 is connected to a third port P3 of the microcomputer 135. The check button 42 may be provided to the conventional control panel 7 (See FIGS. 1 and 3), which has a plurality of input buttons, or may be the combination of a plurality of input buttons.

Figure 7:
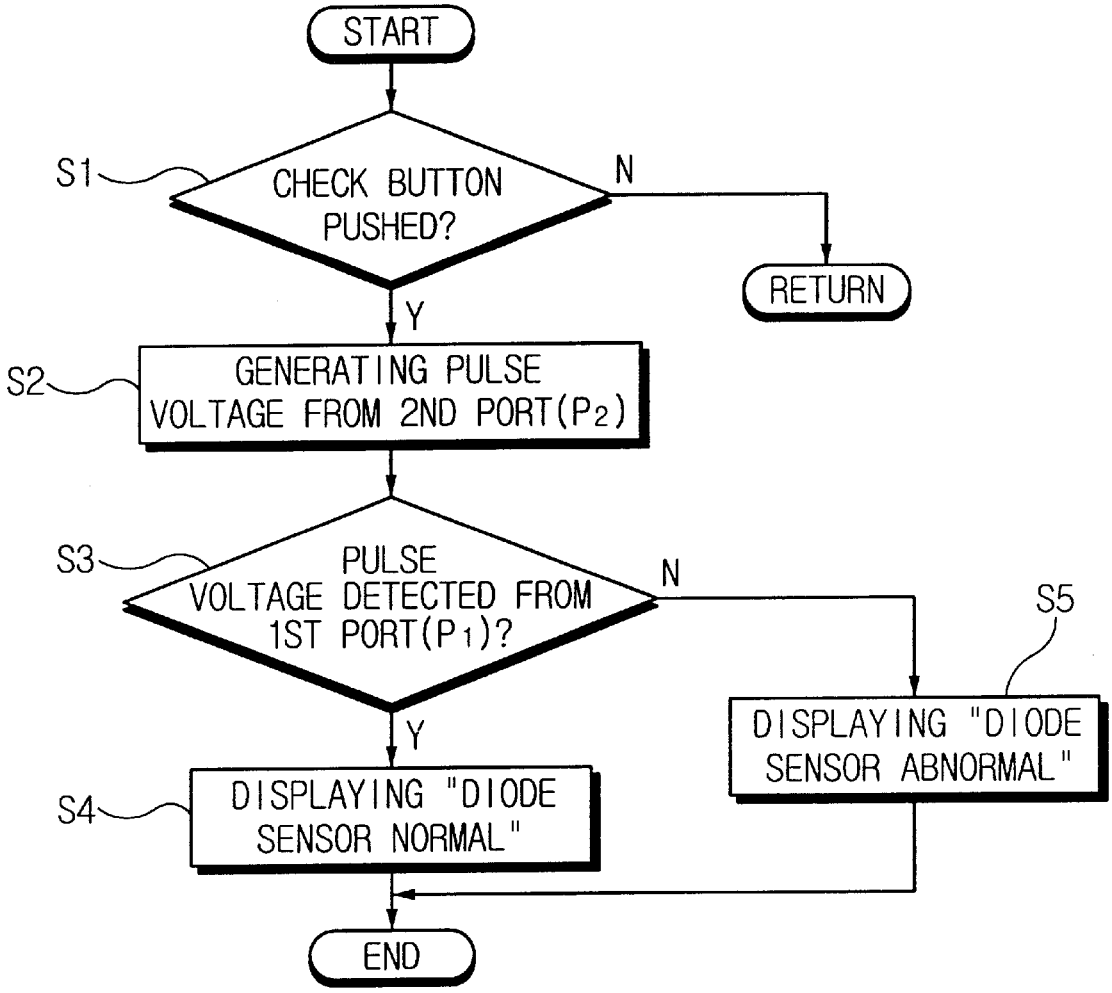
FIG. 7 is a flow chart for explaining operations of the microwave oven of FIG. 6.

The operations of the microwave oven having the microwave detecting device according to the second preferred embodiment of the present invention will be described below:

FIG. 7 is a flow chart for explaining the operations of the microwave oven of FIG. 6. When the microwave oven is turned on, the microcomputer 135 determines if the check button 42 is pushed (Step S1). When the check button 42 is not pushed, the microcomputer 135 carries out the usual main algorithm. On the other hand, when the check button 42 is pushed, the signal corresponding thereto is inputted to the third port P3 of the microcomputer 135. As the signal is inputted to the third port P3, the microcomputer 135 generates the pulse voltage of a uniform degree such as 5 volts from the second port P2 (Step S2). In this situation, if the diode sensor D is normal, the pulse voltage is inputted to the first port P1 of the microcomputer 135 through the resistor R1. Meanwhile, if the diode sensor D is broken and is shunted, the voltage of the first port P1 becomes zero (0) degree even when the voltage is applied to the first port P1 through the resistor R1. When the voltage is outputted from the second port P2, the microcomputer 135 detects the voltage of the first port P1. If the voltage is detected from the first port P1, then the microcomputer 135 displays a message indicating normal status of the diode sensor, such as "diode sensor normal", etc., through the display section 7A (Step S4). If the voltage is not detected from the first port P1, the microcomputer 135 displays a message indicating abnormal status of the diode sensor D such as "diode sensor abnormal" through the display section 7A (Step S5).

As described above, in the microwave oven according to the present invention, the microcomputer detects not only the microwave in the waveguide, but also the presence of the abnormality of the diode sensor, and when the abnormality occurs in the microwave oven, it is displayed through the display section by indicating whether the abnormality of the microwave oven is due to the magnetron or the diode sensor.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven comprising:

a microcomputer;

a microwave detecting section for detecting whether microwave energy is present in a waveguide providing microwave energy to the oven;

said microwave detecting section comprising testing means for determining whether the microwave detecting section is normal and for providing a test result representative of the determination, said microwave detecting section under the control of the microcomputer; and a display section for displaying the test result of the microwave detecting section testing means, said display section under the control of the microcomputer.

2. The microwave oven as claimed in claim 1, wherein a predetermined voltage is detected at a first input port of the microcomputer when microwave energy is present in the waveguide.

3. The microwave oven as claimed in claim 2, wherein the microwave detecting section testing means includes a resistor connected between an output port of the microcomputer and an input port of the microwave detecting section.

4. The microwave oven as claimed in claim 3, wherein the microcomputer applies a predetermined voltage to the resistor through the output port of the microcomputer, and determines whether the microwave detecting section is normal according to whether a corresponding voltage is detected at the first input port of the microcomputer.

5. The microwave oven as claimed in claim 4, wherein the predetermined voltage applied to the resistor by the microcomputer is a pulse.

6. The microwave oven as claimed in claim 2, wherein the microwave detecting section is tested when no predetermined voltage is detected at the first input port of the microcomputer when a magnetron is driven.

7. The microwave oven as claimed in claim 2, wherein the microwave detecting section includes a diode sensor connected between a loop antenna protruding inside the waveguide and the first input port of the microcomputer in a forward direction, and the microwave detecting section testing means tests whether the diode sensor is normal.

8. The microwave oven as claimed in claim 7, wherein the display section displays whether the diode sensor is normal.

9. The microwave oven as claimed in claim 1, wherein the microwave detecting section is tested when an external signal is applied to the microcomputer.

10. The microwave oven as claimed in claim 9, wherein the external signal is applied by a testing key connected to a second input port of the microcomputer.

11. The microwave oven as claimed in claim 9, wherein the external signal is applied by a combination of a plurality of keys arranged on a control panel located on an external surface of the microwave oven.

12. A control method for a microwave oven, said microwave oven comprising a waveguide and a microwave detecting section for detecting whether microwave energy is present in the waveguide, said microwave detecting section under the control of a microcomputer, said microwave oven further comprising the steps of:

testing whether the microwave detecting section is normal when a magnetron is driven, whereby a test result is generated; and displaying the test result on the display section.

13. The control method as claimed in claim 12, wherein a predetermined voltage is detected at a first input port of the microcomputer when microwave energy is present in the waveguide.

14. The control method as claimed in claim 13, wherein the testing of the microwave detecting section is performed by microwave detecting section testing means including a resistor connected between an output port of the microcomputer and the microwave detecting section.

15. The control method as claimed in claim 14, wherein the microcomputer applies a predetermined voltage to the resistor through the output port, and determines whether the microwave detecting section is normal according to whether a corresponding voltage is detected at the first input port.

16. The control method as claimed in claim 15, wherein the predetermined voltage applied to the resistor by the microcomputer is a pulse.

17. The control method as claimed in claim 13, wherein the testing of the microwave detecting section is preformed when no predetermined voltage is detected at the first input port of the microcomputer when a magnetron is driven.

18. The control method as claimed in claim 13, wherein the microwave detecting section includes a diode sensor connected between a loop antenna protruding inside the waveguide and the first input port of the microcomputer in a forward direction, and the testing means tests whether the diode sensor is normal.

19. The control method as claimed in claim 18, wherein the display section displays a display representative of whether the diode sensor is normal.

20. A control method for a microwave oven, said microwave oven comprising a waveguide and a microwave detecting section for detecting whether microwave energy is present in the waveguide, said microwave detecting section under the control of a microcomputer, said microwave oven further comprising the steps of:

testing whether the microwave detecting section is normal when an external signal is applied to the microcomputer, whereby a test result is generated; and displaying the test result on the display section.

21. The control method as claimed in claim 20, wherein the external signal is applied by a testing key connected to a second input port of the microcomputer.

22. The control method as claimed in claim 20, wherein the external signal is applied by a plurality of keys arranged on a control panel located on an external surface of the microwave oven.

23. The control method as claimed in claim 20, wherein a predetermined voltage is detected at a first input port of the microcomputer when microwave energy is present in the waveguide.

24. The control method as claimed in claim 23, wherein the microwave detecting section is tested by microwave detecting section testing means including a resistor connected between an output port of the microcomputer and the microwave detecting section.

25. The control method as claimed in claim 24, wherein the microcomputer applies a predetermined voltage to the resistor through the output port, and determines whether the microwave detecting section is normal according to whether a corresponding voltage is detected at the first input port.

26. The control method as claimed in claim 25, wherein the predetermined voltage applied to the resistor by the microcomputer is a pulse.

27. The control method as claimed in claim 23, wherein the microwave detecting section includes a diode sensor connected between a loop antenna protruding inside the waveguide and the first input port of the microcomputer in a forward direction, and the microwave detecting section testing means tests whether the diode sensor is normal.

28. The control method as claimed in claim 27, wherein the display section displays whether the diode sensor is normal.

* * * * *